US005435741A

United States Patent [19]

Wang

[11] Patent Number: 5,435,741

[45] Date of Patent: Jul. 25, 1995

[54] BULB FASTENING STRUCTURE FOR CHRISTMAS LIGHT STRINGS

[76] Inventor: Jen-Sheng Wang, 9F-2, No. 70, Sec. 2, Tunha S. Road, Taipei, Taiwan

[21] Appl. No.: 226,326

[22] Filed: Apr. 12, 1994

[51] Int. Cl.[6] ..... H01R 4/50

[52] U.S. Cl. ..... 439/336; 439/314; 439/356

[58] Field of Search ..... 313/318; 439/312, 314, 439/315, 336, 488, 489, 356, 611–619, 699

[56] References Cited

U.S. PATENT DOCUMENTS 4,290,092 9/1981 Bull ..... 439/314 X
4,597,032 6/1986 Kirby ..... 439/314 X
4,758,181 7/1988 Reedy ..... 439/336 X
5,368,503 11/1994 Savage, Jr. ..... 439/356 X

*Primary Examiner*—Khiem Nguyen
*Attorney, Agent, or Firm*—Bacon & Thomas

[57] ABSTRACT

A bulb fastening structure for christmas light strings is disclosed. The structure includes a cap, a bulb, and a socket. It is characterized by that the cap includes an inner groove formed thereon to receive a flange formed on the bulb so as to retain the bulb and a pair of inner L-shaped projections formed thereon to serve with a pair of external inverse L-shaped projections formed on the socket so that the cap securely engages the socket and fastens the bulb between the cap and the socket.

2 Claims, 5 Drawing Sheets

BULB FASTENING STRUCTURE FOR CHRISTMAS LIGHT STRINGS

FIELD OF THE INVENTION

The present invention relates generally to a bulb fastening structure for christmas light strings and more particularly to the structure including a cap, a bulb and a socket in which they are coupled to securely fasten the bulb between the cap and the socket.

BACKGROUND OF THE INVENTION

Christmas multicolored light strings are widely used for decoration during many special holidays. They are most often seen on christmas trees which are decorated together with other ornaments.

In general, the sockets of the light strings are electrically connected in series so that the disconnection of even only one bulb breaks the electrical circuit and renders the entire light strings to fail. Therefore, an effective and secured fastening structure for retaining a bulb in a socket is urgently required.

As shown in FIG. 6, a conventional bulb and socket device in christmas light strings, for example disclosed in U.S. Pat. No. 4,943,899, generally includes a bulb 60 and a socket 70. The bulb 60 includes a lighting element 61, an inserting base 62 having two leads 621 oppositely mounted on two sides thereof, and two tongues 63 which extends outward from two upper sides of the base 62 respectively. Each tongue 63 has a slot 631 formed adjacent to a free end thereof. The socket 70 has two T-shaped male members 71 oppositely formed and adjacent to the top margin thereon. The inserting base 62 is retainable within a central hole 72 of the socket 70 and the leads 621 are contactable onto an unshown electrical circuit. The bulb 60 is further fastened to the socket 70 by bending each tongue 63 downward and pushing the tongue 63 against the T-shaped male member 71 so that a snapping head 711 formed on the T-shaped male member 71 is forced through the slot 631.

The tightening ability of the abovementioned structure is based on the deformable strength of the tongue 63 itself and the retaining force exerted on the tongue 63 through the retained slot 631 by the snapping head 711 of the T-shaped male member 71. The severe defect in such design is that the tongue 63 is quite often broken apart resulting from possibly repeated or accidental bending during manufacturing or assembling the light strings.

SUMMARY OF THE INVENTION

Accordingly, it is a primary object of the present invention to provide a bulb fastening structure to overcome the problem in the prior art.

In accordance with the above object, the bulb fastening structure includes a cap, a bulb, and a socket in which they are coupled to securely fasten the bulb between the cap and the socket.

The above objects, features and advantages of the invention will become readily apparent from the following detailed description thereof which is to be read in connection with the accompanying drawings.

DETAILED DESCRIPTION OF THE PREFERRED EMBODIMENT

Figure 1:
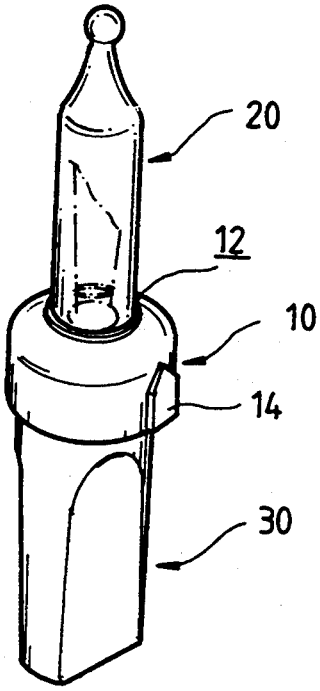
FIG. 1 is a perspective view of a bulb fastening structure in accordance with the present invention.
Figure 2:
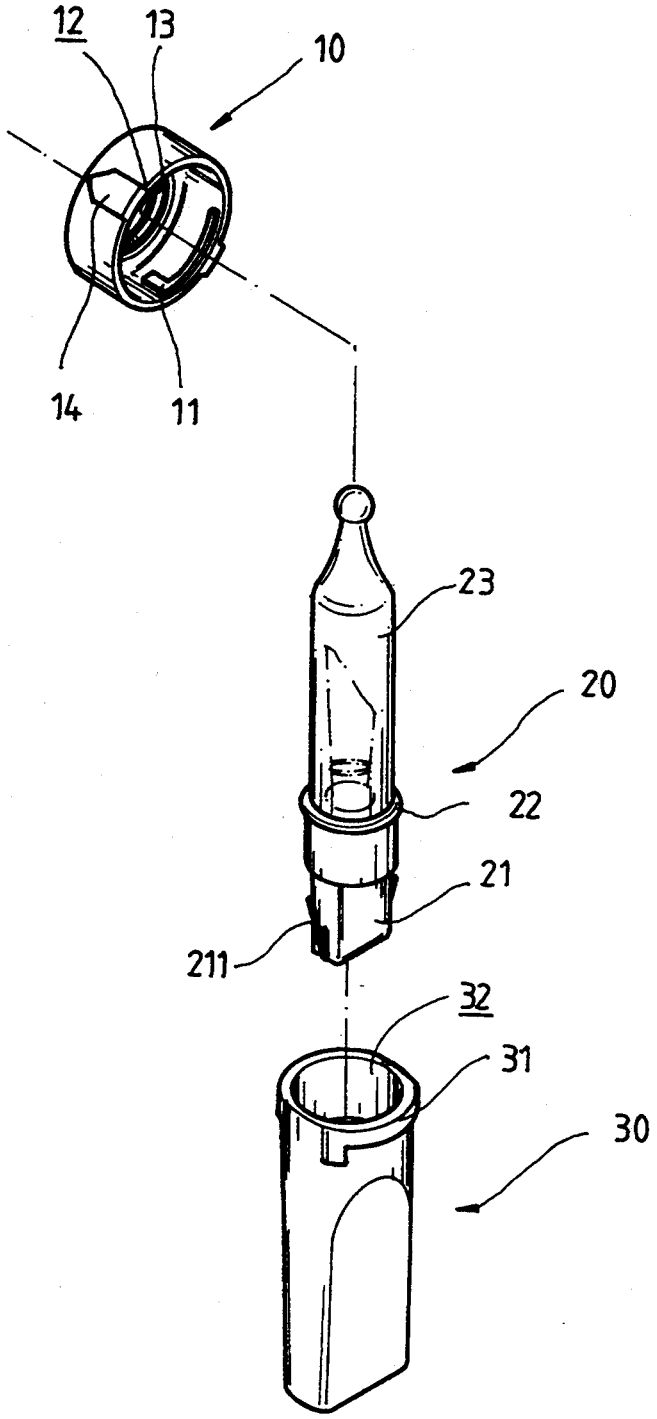
FIG. 2 is an exploded perspective view of the bulb fastening structure including a cap, a bulb and a socket in accordance with the present invention.

Referring to the drawings and in particular to FIGS. 1 and 2, a bulb fastening structure constructed in accordance with the present invention comprises a cap 10, a bulb 20, and a socket 30.

The cap 10 having an inner space includes a pair of inner L-shaped projections 11 oppositely formed thereon and adjacent to the bottom margin thereof, a top opening 12 formed thereof, an inner groove 13 formed thereon adjacent to the top margin thereof, and a pair of external markers 14 oppositely formed thereon.

The bulb 20 includes an inserting base 21 having a pair of leads 211 oppositely mounted on two sides thereof, a flange 22 encircling the top margin of the base 21, and a lighting element 23 attached to the top surface of the base 21 and electrically connected to the leads 211.

The socket 30 includes a pair of external inverse L-shaped projections 31 oppositely formed thereon and adjacent to the top margin thereof and a central hole 32 thereof.

Figure 3:
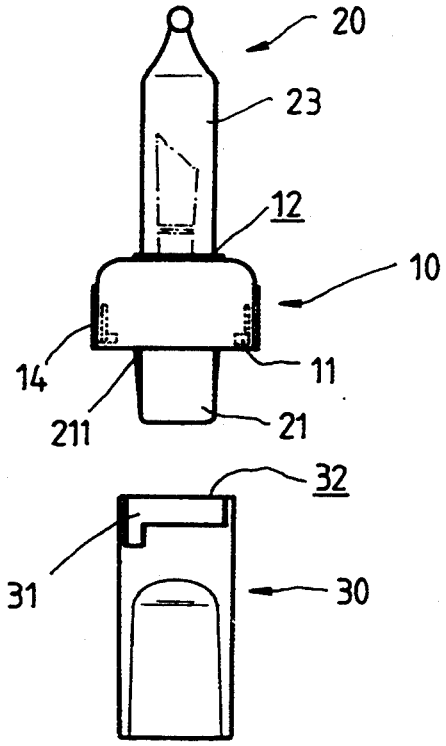
FIG. 3 is an elevational view of the bulb fastening structure in accordance with the present invention showing the cap securely retaining the bulb but departing the socket.

With reference to FIG. 3, it shows the cap 10 securely retaining the bulb 20 but departing the socket 30. The lighting element 23 extends upward through the opening 12 of the cap 10 and the flange 22 is forced against the groove 13 to be disposed within the groove 13. Then, the cap 10 securely retains the bulb 20.

Figure 4:
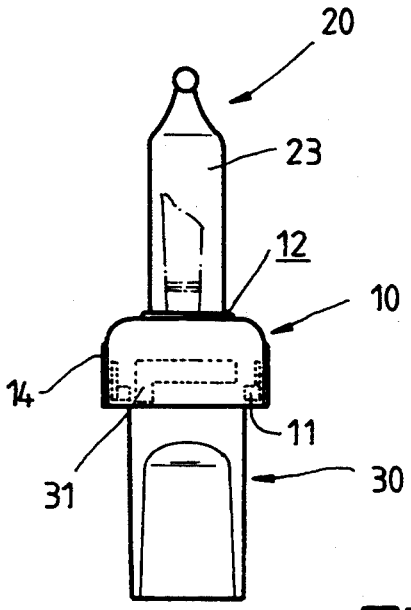
FIG. 4 is an elevational view of the bulb fastening structure in accordance with the present invention showing the cap securely retaining the bulb and the socket but disengaging the socket.

With reference to FIG. 4, the inserting base 21 extends downward through the central hole 32 of the socket 30 and is securely disposed within the socket 30 so that the leads 211 are contactable onto an unshown external electrical circuit. The cap 10 disengages the socket 30 at this step. The relative positions of the external inverse L-shaped projections 31 of the socket 30 and the inner L-shaped projections 11 of the cap 10 are shown by phantom lines.

Figure 5:
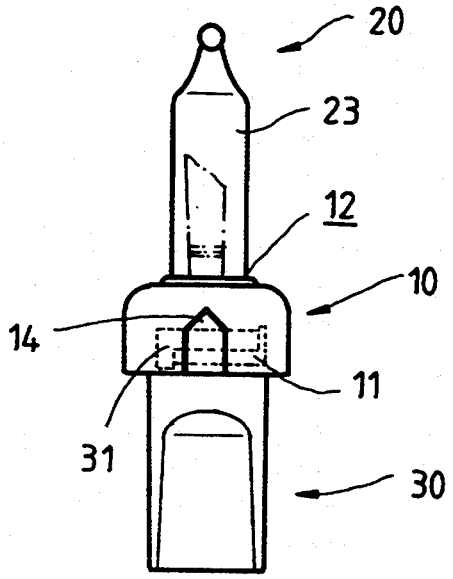
FIG. 5 is an elevational view of the bulb fastening structure in accordance with the present invention showing the cap and the socket serve together to securely fasten the bulb therebetween.
Figure 6:
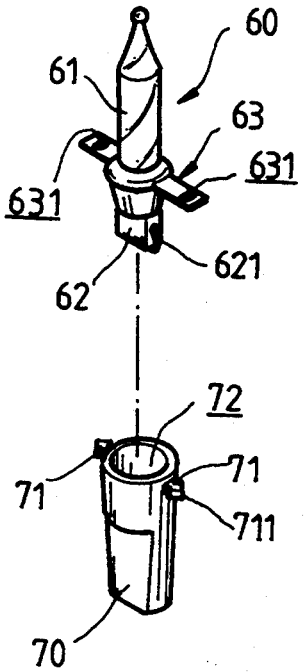
FIG. 6 PRIOR ART
FIG. 6 is a perspective view of a bulb and socket device in christmas light strings of a prior art.

When the cap 10 is rotated in 90 degrees, the relative positions shown in FIG. 4 change into that shown in FIG. 5. The external inverse L-shaped projections 31 of the socket 30 and the inner L-shaped projections 11 of the cap 10 serve together to form a rectangular shape so that the cap 10 securely engages the socket 30 and fastens the bulb 20 between the cap 10 and the socket 30. The external markers 14 serve to indicate the status that the cap 10 engages the socket 30.

Having described the specific preferred embodiment of the present invention with reference to the accompanying drawings, it will be appreciated that the present invention is not limited to that precise embodiment and that various changes and modifications can be effected therein by one of ordinary skill in the art without departing from the scope or spirit of the invention as defined by the appended claim.

What is claimed is:

1. A bulb fastening structure for christmas light strings comprising a cap, a bulb, and a socket; said cap comprising at least one inner L-shaped projection formed thereon, a top opening formed thereof, an inner groove formed thereon; said bulb comprising an inserting base thereof, a flange encircling said base, and a lighting element attached to said base and electrically connected to leads of said bulb; said socket comprising at least one external inverse L-shaped projection and a central hole thereof; said lighting element extending upward through said opening of said cap and said flange forced against said groove to be disposed within said groove so that said cap securely retains said bulb; said inserting base extending downward through said central hole of said socket and securely disposed within said socket so that said leads are contactable onto an external electrical circuit; said external inverse L-shaped projection of said socket and said inner L-shaped projection of said cap serving together to form a rectangular shape so that said cap securely engages said socket and fastens said bulb between said cap and said socket.

2. A bulb fastening structure as claimed in claim 1, wherein said cap further comprises at least one external marker serving to indicate the status that the cap engages the socket.

* * * * *